United States Patent [19]

Nyack, Jr. et al.

[11] Patent Number: 4,602,547

[45] Date of Patent: Jul. 29, 1986

[54] ELECTRIC GUITAR

[76] Inventors: Norris Nyack, Jr.; Michael Nyack, both of P.O. Box 23102, Los Angeles, Calif. 90023

[21] Appl. No.: 732,882

[22] Filed: May 6, 1985

Related U.S. Application Data

[63] Continuation of Ser. No. 574,718, Jan. 30, 1984, abandoned.

[51] Int. Cl.[4] ..... G10H 3/00

[52] U.S. Cl. ..... 84/1.15; 84/1.16

[58] Field of Search ..... 84/1.15, 1.16, 298, 84/299, 314 P

[56] References Cited

U.S. PATENT DOCUMENTS 3,962,946 6/1976 Rickard ..... 84/1.15
3,992,972 11/1976 Rickard ..... 84/1.15
4,135,426 1/1979 Rickard ..... 84/298
4,186,641 2/1980 Dorfman ..... 84/1.16

FOREIGN PATENT DOCUMENTS 0153065 9/1951 Australia ..... 84/1.15

*Primary Examiner*—Forester W. Isen
*Attorney, Agent, or Firm*—Beehler, Pavitt, Siegemund, Jagger & Martella

[57] ABSTRACT

An improved electric guitar is disclosed, having strings closely spaced from the body and fingerboard of the guitar and magnetic pick-ups mounted under the pick-guard of the guitar, the cores of the magnetic pick-up protruding through the pick-guard into proximity with the lowered strings to thereby enhance the sound output of the instrument while also improving the playing characteristics of the guitar.

5 Claims, 4 Drawing Figures

ELECTRIC GUITAR

CONTINUING DATA

This application is a continuation of Ser. No. 574,718 filed Jan. 30, 1984, now abandoned.

BACKGROUND OF THE INVENTION

1. Field of the Invention

The present invention pertains to the field of stringed musical instruments and is more particularly directed to an electric guitar having improved sound and playing characteristics.

2. State of the Prior Art

So-called electric guitars have been known and in popular use for many years. Typically, the instrument consists of a solid body to which is mounted an elongated neck terminating in a head portion. Conventional instruments include a pick-guard surface on the body and a finger board surface extending substantially the length of the neck. The body is partly covered by laminate such as formica which defines the pick-guard surface and is intended to protect the usually wooden body against damage by the sharp edge of the string pick. A bridge is mounted to the body for anchoring by means of a mounting plate. A number of strings at one end, the opposite end of the strings being attached to tuning pegs mounted to the head, such that the strings extend in a flat or somewhat cylindrical plane overlying and spaced from the pick-guard and finger board surfaces. One or more magnetic pick-ups are mounted to the body directly underneath the strings. The pick-ups are connected to an electrical output jack through which the guitar is connected to an electronic audio amplifier and speaker system. Typically, more than one magnetic pick-up is provided, sometimes with switches for selecting any desired combination of pick-ups, together with volume controls for adjusting the relative output of the pick-ups.

The strings extend from the bridge over the pick-guard and finger board surfaces through a transverse nut bar which is grooved to receive each of the strings. The height of the strings is normally adjustable at the bridge end by means of adjustment screws. At the opposite or nut end the strings are supported in overlying spaced relationship to the finger board of the neck by means the nut. The height of the strings above the finger board surface of the neck is determined by the dimensions of the nut. The height of the strings at the nut end is normally not adjustable. A plurality of parallel frets are mounted to the finger board surface and specific notes are produced by touching a particular string to a selected fret so as to thereby set the effective resonant length of the string as measured between the selected fret and the bridge.

SUMMARY OF THE INVENTION

It has been found that an improved, richer sound can be obtained from an electric guitar by lowering the strings closer to the guitar body and to the finger board surface. This is accomplished primarily by mounting the bridge in a recess formed in the body, to lower the strings at one end by cutting deeper grooves in the nut to lower the strings at the other end. The neck of the guitar is also modified to lower the finger board surface closer than in conventional to the level of the pick-guard surface. The conventional guitar frets are replaced by mandolin frets of smaller cross section to prevent buzzing of the strings against the frets.

These modifications in combination produce closer coupling between the strings and the guitar body than has heretofore been achieved in electric guitars. This enhanced coupling alters the character and quality of sound output of the magnetic pick-ups. This is because the magnetic pick-ups, while designed to respond to magnetic fluctuations vicinity, are also responsive to mechanical vibration.

Magnetic pick-ups of the type used in electric guitars have a relatively limited angle of pick-up, i.e., the devices interact magnetically with a relatively short length of the metallic guitar strings directly overlying each pick-up and extending a short distance to either side thereof. As a result, it is common practice to use a number of pick-ups spaced from each other along the direction of the strings, each pick-up being best positioned for sensing a particular frequency range. For example, three such pick-ups might be positioned for optimally responding to bass, midrange amd treble frequencies, and the outputs of such three pick-ups may be mixed to obtain a desired quality of sound. In the present invention, the magnetic pick-up coils are mounted below the pick-guard in a cavity formed in the guitar body so as to increase the mechanical response of the pick-up to acoustic vibration of the guitar body. The pick-up cores however protrude through openings in the pick-guard and extend into proximity with the strings so as to also maximize the angle of magnetic interaction with the guitar strings.

By enhancing the coupling of the strings with the guitar body according to the present invention the mechanical interaction between the vibrating strings and the magnetic pick-ups is substantially increased. Further, the mechanical coupling to the magnetic pick-ups is not limited to a particular frequency range dependent on the location of the pick-up relative to the strings but extends to substantially the full tonal range produced by the strings including harmonics and overtones. Such mechanically coupled acoustic energy is added onto the magnetically induced sound output of the pick-ups resulting in a fuller, richer tone than has been obtained with magnetic pickups in the past. The sound output of a guitar constructed according to this invention more closely resembles the sound of an acoustic guitar than that of an electric guitar.

In one embodiment of the invention this enhanced mechanical coupling of the strings to the body is further exploited by use of separate acoustic type pick-up mounted to the guitar body and which may be switch selectable as an alternate signal source of used in combination with magnetic pick-ups for greater versatility and unusual sound.

A further benefit of a guitar constructed according to the present invention is that the strings are brought very close to the finger board surface of the neck, and the usual, relatively thick guitar frets are replaced by much thinner mandolin frets. The spacing of the strings to the frets is thus considerably reduced and notes or chords may be obtained very easily, by simply touching the strings to the fret with far less effort than required in conventional guitars.

A still further benefit derived by the present invention is that by bringing the strings closer to guitar body and neck the long term tendency of the neck to buckle and bend under the tension of the strings is reduced.

DETAILED DESCRIPTION OF THE PREFERRED EMBODIMENTS

Figure 1:
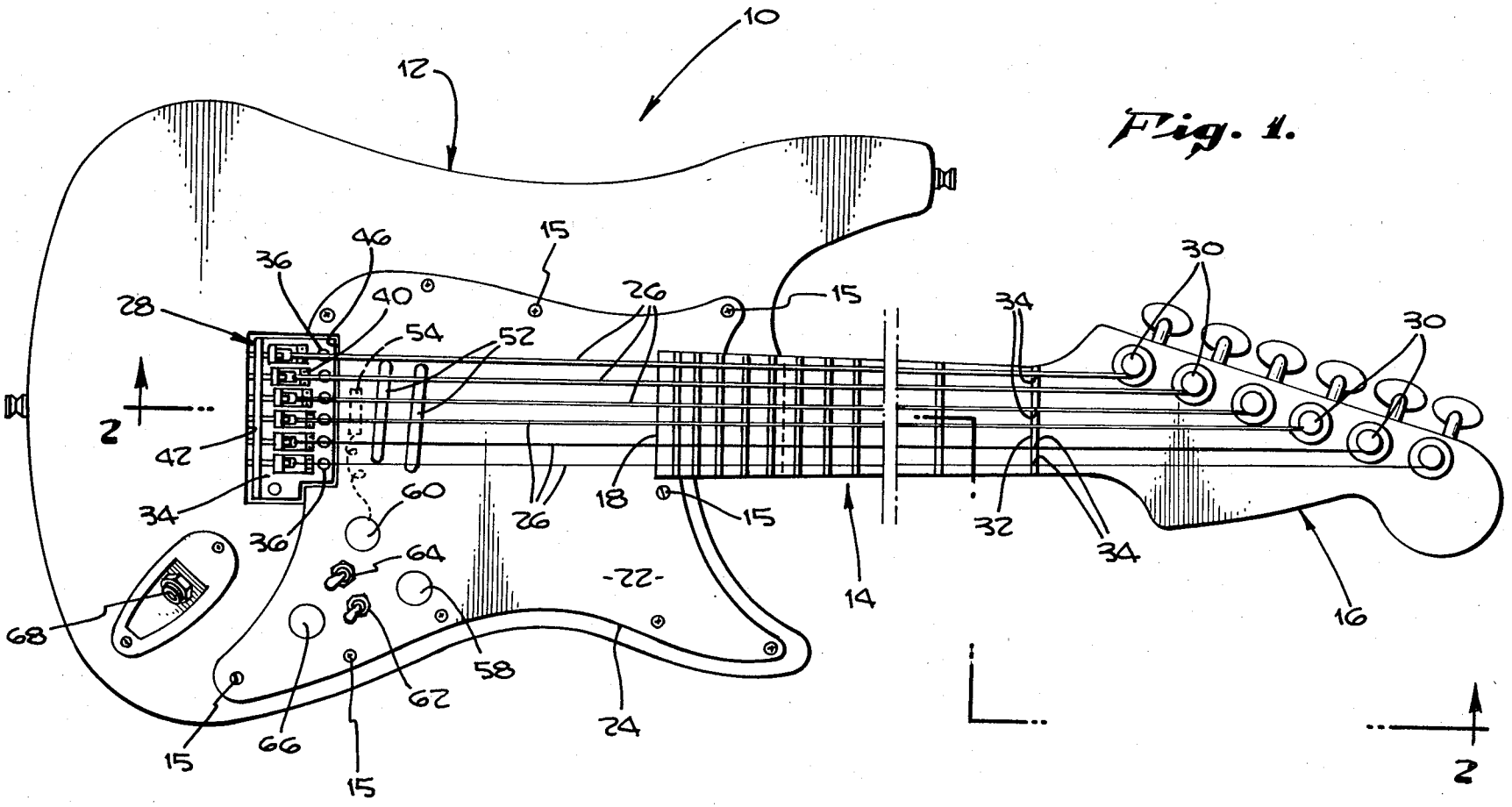
FIG. 1 is a plan view of an electric guitar according to the present invention with an intermediate portion of the guitar neck removed for ease of illustration.

With reference to the drawings and FIG. 1 in particular, an electric guitar 10 constructed according to the present invention has a solid guitar body 12 to which is affixed a neck 14 shown with an intermediate section broken away for ease of illustration. The neck terminates in a head 16. Guitar necks and guitar bodies wooden blanks are commercially available as separate unfinished wooden blanks and are fitted and fixed together in a manner best appreciated in the cross-sectional view of FIG. 2 such that there is a step 18 between the finger board surface 20 of the neck and the pick-guard surface 22 of the body. The cross section of the neck blank is reduced and/or the depth of the neck mounting recess in the body is increased to reduce the height of the step 18 to approximately 3/32 of an inch. The pick-guard surface is defined by a pick-guard 24 which may be a relatively thin sheet of laminate material such as formica or equivalent scratch resistant material fixed to the body 12 by means such as screws 15.

Strings 26 extend in a plane spaced from and parallel to both the pick-guard surface 22 and the finger board surface 20. The strings are anchored at one end to a bridge 28 and at the opposite end to individual tuning pegs 30 mounted to the head 16. A nut 32 is mounted at the upper end of the finger board surface of the neck, just below the head 16. The strings 26 lie within individual grooves 34 formed in the nut which keep the strings in fixed spaced relationship to each other. The height of the strings 26 above the finger board surface 20 is also determined by the depth of the grooves 34.

The bridge 28 is of conventional construction and is provided with a mounting plate 34 which is secured to the body of the guitar by means of screws 36 and is further provided with string anchors 38 which include individual height adjustment screws 40 for each string 26.

According to the present invention, the bridge 28 is mounted within a recess 42 formed in the guitar body 12. The depth of the recess 42 may be approximately ⅛ inch which is also the approximate thickness of the mounting plate 34 in conventional electric guitar bridges. Thus, the top surface of the mounting plate is approximately flush with the face 44 of the guitar body. The recess 42 is shaped to receive the mounting plate of the bridge as best seen in FIG. 1 and includes an edge 46 against which abuts the edge 48 of the bridge mounting plate.

The neck piece 14 is fitted to the guitar body 12 such that the height of step 18 at the transition between the finger board 20 and the pick-guard surface 22 is substantially smaller than in finger board surface. Thus, it is necesary to replace the conventional guitars and is of the order of 3/32 (three thirty seconds) of an inch or less. The string grooves 34 in the nut 32 are cut deeper than is conventional to thereby bring the plane of the strings 26 closer to the finger board surface 20. The presently preferred height of the strings above the finger board 20 is 3/32 (three thirty seconds) of an inch. Such close spacing of the strings would not be possible with conventional relatively thick guitar frets which rise to an excessive height above the finger board surface. Thus, it is necessary to replace the conventional guitar frets with so called mandolin frets which are of considerably smaller cross section.

The height of the strings at the bridge end relative to the pick-guard surface 22 is further reduced by adjustment of the height adjustment screws 40 of the bridge 28 to near minimum, thereby also leveling the strings relative to the finger board surface 20.

Figure 2:
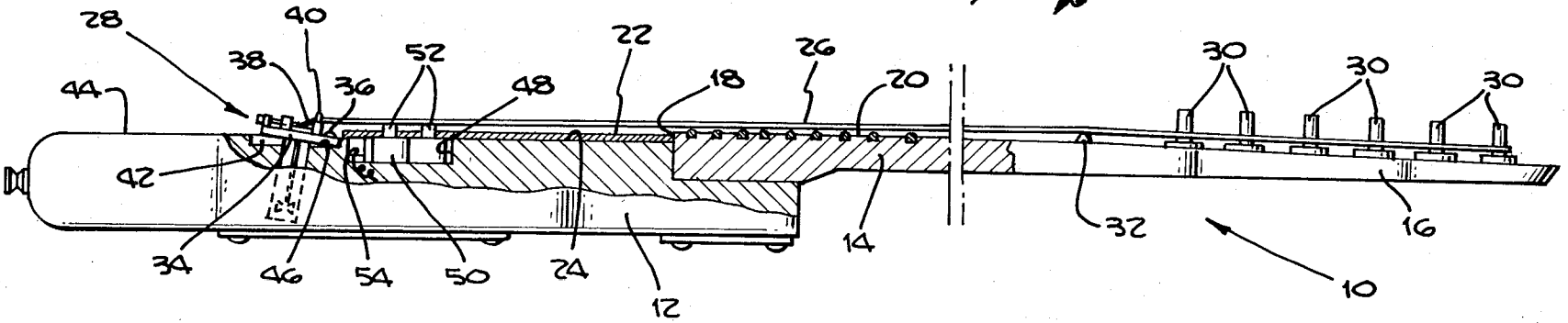
FIG. 2 is a cross-section taken along line 2—2 in FIG. 1.

A magnetic pick-up 50 which in the illustrative embodiment is a commercially available Demazio X2N dual pick-up is mounted in a cavity 48 formed in the guitar body 12. The aforementioned X2N pick-up 50 has been modified by partially pulling out the normally fixed cores 52 from the pick-up coil winding to bring the cores closer to the plane of the guitar strings 26. The pick-up 50 is mounted by gluing the top surface of the pick-up case to the underside of the pick-guard sheet 24 as best seen in FIG. 2.

The partially pulled out cores 52 protrude upwardly through slot openings formed in the pick-guard 24 while the bottom of the pick-up 50 may rest one the bottom surface of the cavity 48.

It will be appreciated that the sunken mounting of the bridge 28 to the guitar body 12 in combination with a lowered finger board surface 20 relative to the pick-guard surface 22 and the deeper string grooves 34 in the nut 32, results in a lowering of the lines of force imposed between the head 16 and the bridge 28 due to the tension of the strings stretched therebetween. This displacement of the stress lines is particularly affected by the sunken mounting of the bridge plate 34 where the screws 36 enter the solid body 12. In conventional guitars the bridge is mounted to the surface 44 of the guitar body so that the anchor point of the bridge is higher up and essentially outside the body 12. By sinking the mounting point of the bridge plate and lowering the plane of the strings a higher degree of mechanical coupling between the vibrating strings 26 and the body 12 is achieved. The response of the pick-up 50 to the mechanically coupled vibrations of the strings 26 combine with the normal electromagnetic response of the pick-up to produce an output signal having a higher harmonic content than has been obtained in the past without need for multiple pick-ups spaced along the strings 26.

The modification of the pick-up 50 consisting of the partial extraction of the cores 52 allow the pick-up coil to be mounted within the body of the guitar for maximum mechanical coupling to the guitar body while also retaining close proximity of the pick-up cores to the string plane for maximum sensitivity to the varying magnetic field induced by plucking of the strings 26. A further benefit obtained by maintaining close proximity of the cores to the plane of the strings is that the cores are sensitive to vibrations of a greater length of the string along a distance to either side of the pick-up. This enhances the richness and harmonic content of the conventional magnetic response of the pick-up because different sound frequencies and harmonics thereof are produced as standing waves located at different points along the strings 26, depending on the frequencies, involved. By bringing the cores 52 close to the strings 26, the pick-up becomes responsive to oscillations of a longer segement of each string, thus enriching the sound output of the instrument with a greater variety of harmonics.

To fully take advantage of the improved characteristics of this guitar an acoustic pick-up 54 may be mounted as by a friction fit within a cavity 56 formed in the guitar body 12. The electrical outputs of the magnetic pick-up 50 and the acoustic pick-up 54 may be connected through individual volume controls 58 and 60 and switches 62 and 64 respectively to a master volume control 66 and finally to an output jack 68. The relative levels of the two pick-ups 50 and 54 may be adjusted by the respective controls 58 and 60. The switches 62, 64 allow selection of one or both of the pick-ups, while the master control 66 allows control over the combined outputs of the two pick-ups for feeding to an external amplifier system through the output jack 68. If desired, a pre-amplifier including battery power supply therefor may be built into the body of the guitar so that head phones may be connected to the output jack 68 for proviate listening.

Figure 4:
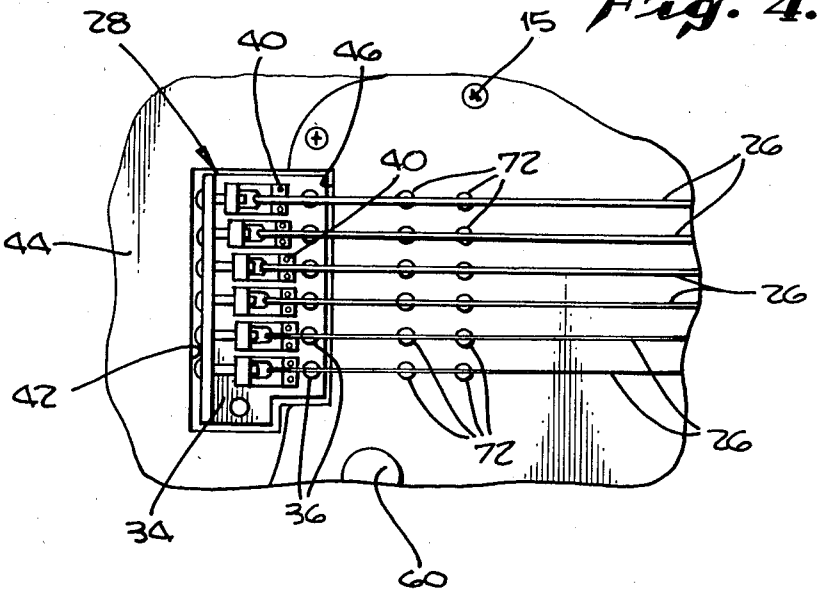
FIG. 4 is a partial plan view of the bridge area of the guitar according to the alternate embodiment of FIG. 3.
Figure 3:
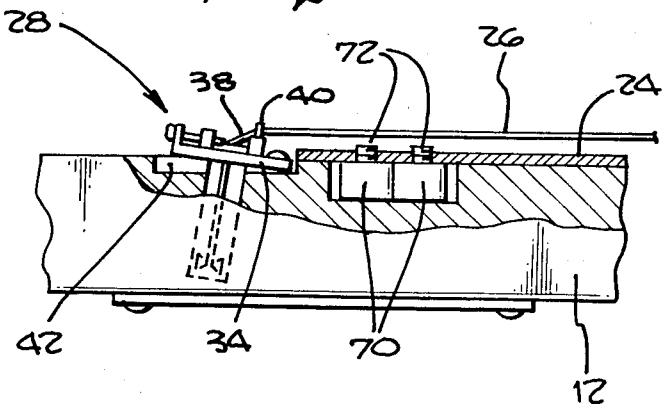
FIG. 3 is a sectional view similar to that of FIG. 2 of an alternate embodiment using magnetic pick-ups having adjustable cores and no separate acoustic type pick-up in the body of the guitar.

An alternate embodiment of the invention is illustrated in FIGS. 3 and 4 wherein a pick-up 70 such as a Demazio "Super Distortion" type has been installed instead of the X2N pick-up 50 of FIGS. 1 and 2. Pick-up 70, unlike the pick-up 50 of FIG. 2 has adjustable screw-in cores 72 which can be readily raised from the pick-up body and extended upwardly through suitably located and dimensioned holes in the pick-guard 24 into proximity to the respective overlying strings 26, while the pick-up coils remain recessed within the guitar body 12 so as to better respond to the mechanically coupled string vibrations.

It must be understood that many alterations and modifications may be made by those having ordinary skill in the art to the present invention without departing from the spirit and scope of the invention. Therefore, the presently illustrated embodiments have been shown only by way of example and for the purpose of clarity and should not be taken to limit the scope of the following claims.

What is claimed is:

1. A method of mounting an electromagnetic pick-up to a guitar having a solid body including a face surface, a bridge, a neck and a pick guard sheet extending substantially from said bridge to said neck, said pick-up including a pick-up case having a pick-up bottom, a top surface and at least one pick-up core partially protruding from said case, comprising the steps of:

partially extracting said least one core from said pick-up case;

forming an opening in said pick-guard for each of said pick-up cores;

making a cavity having a cavity bottom in said face surface of said guitar body said cavity being dimensioned to a depth such that the bottom of said pick-up case rests on the bottom of the cavity in contact with said solid body and the top surface of the pick-up case contacts the underside of said pick guard;

placing the pick-up in said cavity formed in the solid body;

affixing said pick guard against said face surface of said solid body, and against the top surface of said pick-up case thereby to fix said pick-up in said cavity wtih only said one or more pick-up core protruding through said pick guard opening.

2. In a musical instrument having a solid body including a face surface, a neck attached to said body and terminating in a head, a bridge mounted to said body by means of a base plate and including string height adjustment means, strings extending between said head and bridge, a pick guard sheet affixed to said face surface, one or more magnetic pick-ups each having a pick-up case including a top surface, a bottom and one or more pick-up cores, one or more pick-up cavities formed in said solid body and covered by said pick-guard sheet, each of said cavities having a cavity bottom, each of said one or more pick-ups being disposed within one of said cavities with said case bottom resting on said cavity bottom and said top surface in contact with the underside of said pick-guard sheet such that said pick-up case is covered by the pick-guard sheet, each said pick-up core protruding upwardly from said pick-up case and extending through a corresponding opening in said pick-guard into proximity with said strings, whereby said magnetic pick-up output is responsive to magnetically coupled vibration of said strings as well as acoustic transmission of string vibrations through said solid body in contact with said pick-up case bottom and said pick-guard in contact with said pick-up case upper surface.

3. The instrument of claim 1 further comprising a nut mounted to the fret surface near the head for supporting the strings in spaced parallel relationship above the fret surface, the nut being grooved to a depth such that the strings lie in a plane spaced less than ¼ inch above the fret surface.

4. The instrument of claim 2 further comprising an acoustic pick-up affixed to said solid body.

5. The instrument of claim 2 wherein said bridge has a base plate mounted in contact with said solid body within a bridge recess defined in said face surface.

* * * * *